US006450082B1

(12) United States Patent
Sawdon

(10) Patent No.: US 6,450,082 B1
(45) Date of Patent: Sep. 17, 2002

(54) SHOT PIN

(75) Inventor: Edwin G. Sawdon, St. Clair, MI (US)

(73) Assignee: BTM Corporation, Marysville, MI (US)

( * ) Notice: Subject to any disclaimer, the term of this patent is extended or adjusted under 35 U.S.C. 154(b) by 6 days.

(21) Appl. No.: 09/740,199

(22) Filed: Dec. 18, 2000

(51) Int. Cl.[7] ..... F15B 15/26; F01C 9/00
(52) U.S. Cl. ..... 92/23; 92/121; 60/403
(58) Field of Search ..... 92/23, 24, 27, 92/121, 140; 60/403

(56) References Cited

U.S. PATENT DOCUMENTS

| | | | | |
|---|---|---|---|---|
| 1,736,171 | A | | 11/1929 | Powell |
| 2,381,999 | A | | 8/1945 | Bonnafe |
| 2,469,182 | A | | 5/1949 | Slater |
| 3,033,175 | A | * | 5/1962 | Stott ..... 92/27 |
| 3,273,878 | A | | 9/1966 | Blatt |
| 3,302,504 | A | | 2/1967 | Fisher |
| 3,545,050 | A | | 12/1970 | Blatt et al. |
| 3,618,931 | A | | 11/1971 | Blatt |
| 3,702,185 | A | | 11/1972 | Blatt |
| 3,730,044 | A | | 5/1973 | Sawdon |
| 4,099,659 | A | | 7/1978 | Grimaldi, Jr. |
| 4,240,620 | A | | 12/1980 | Tunkers |
| 4,396,183 | A | | 8/1983 | Lymburner |
| 4,445,676 | A | | 5/1984 | Tunkers |
| 4,494,739 | A | | 1/1985 | Valentine |
| 4,496,138 | A | | 1/1985 | Blatt |
| 4,591,138 | A | | 5/1986 | Baills et al. |
| 4,633,559 | A | | 1/1987 | Loren |
| 4,905,973 | A | | 3/1990 | Blatt |
| 5,782,130 | A | | 7/1998 | Sawdon |
| 5,860,315 | A | | 1/1999 | Sawdon |

* cited by examiner

*Primary Examiner*—Edward K. Look
*Assistant Examiner*—Michael Leslie
(74) *Attorney, Agent, or Firm*—Harness, Dickey & Pierce, P.L.C.

(57) ABSTRACT

A fluid device includes a rotationally oscillating piston within a sector-shaped chamber, a reciprocating ram for performing work and a link pivotally connected to both the piston and the ram. The piston moves the ram through the link to an extended position and a retracted position. When the ram is in its extended position, the link is moved to an over-center position locking the ram in the extended position. A manually operated unlocking device is provided for moving the piston to eliminate the over-center condition of the link.

20 Claims, 4 Drawing Sheets

SHOT PIN

FIELD OF THE INVENTION

The present invention relates to fluid motors for use in the machine tool field. More particularly, the present invention relates to fluid motors which utilize a simple air driven toggle mechanism for activating the shot pin units.

BACKGROUND OF THE INVENTION

Pneumatic piston and cylinder units are used in a great many different ways for many different functions in connection with the machine tool field. These functions include advancing and retracting tools of various types, advancing and retracting fixtures and the like, advancing and retracting work pieces, ejecting work pieces, work piece locating and work piece clamping, just to name a few. Often it is necessary for these pneumatic cylinder units to provide work functions at closely adjacent points on a work piece or machine. Because of the generally bulky configuration of these piston and cylinder units, it is often necessary in such cases to provide external linkages or levers extending from the piston rod to these closely adjacent points where the application of force is required. The existence of such external levers or other mechanisms presents not only a safety hazard, but it greatly complicates the apparatus necessary to accomplish a given function. In addition, the initial costs and the maintenance costs involved with this complex system are excessive. A good example of where it is often necessary to apply a force on closely spaced centers is in the automobile industry where sheet metal parts need to be precisely located while the parts are assembled, usually by welding.

Prior art devices which are narrow and do not sacrifice output force capacity have been developed. These devices include a rotationally oscillating piston located within a generally sector-shaped chamber, a reciprocating ram element for performing work, internal linkage means interconnecting the ram element and the piston, and means for supplying a fluid under pressure to the chamber. The device is designed to allow the pressurized fluid to be supplied to opposite sides of the piston in order to actuate and de-actuate the piston.

While the prior art devices have performed satisfactorily in the machine tool industry, the continued development of these devices has been directed towards improving their function, their performance and their durability.

SUMMARY OF THE INVENTION

The present invention provides the art with a shot pin which includes a rotary oscillating piston located in a sector-shaped chamber, a reciprocating ram for performing work, and an internal linkage assembly interconnecting the piston and the ram. The shot pin of the present invention includes a mechanism for preventing unlocking of the shot pin from its extended position, a manual unlocking device, a rectangular ram, a hardened scraper and seals which protect the ram as well as numerous other improvement over the systems disclosed in the prior art.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
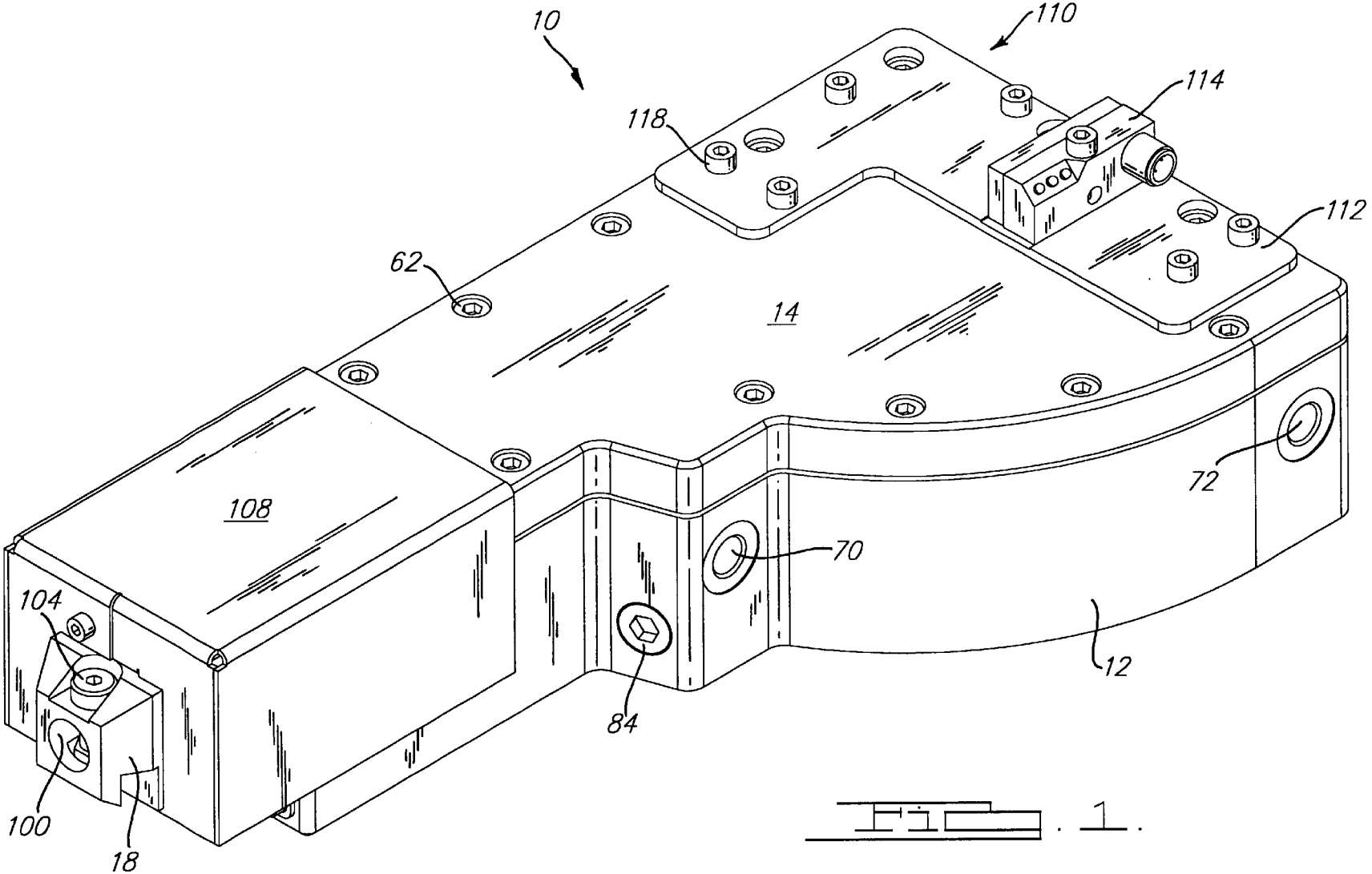
FIG. 1 is a perspective view of an assembled shot pin in accordance with the present invention with the ram in the retracted position.

Referring now to the drawings in which like reference numerals designate like or corresponding parts throughout the several views, there is shown in FIGS. 1–4, an improved shot pin in accordance with the present invention which is designated generally by the reference numeral 10. Shot pin 10 comprises a body 12, a cover plate 14, a piston 16, a ram 18 and a link 20. Body 12 is preferably manufactured from aluminum and it defines an internal chamber 22. Chamber 22 includes a generally rectangular section 24 for accepting ram 18, a generally sector-shaped section 26 for accepting piston 16 and a generally circular section 28 for providing a pivot point for piston 16.

Piston 16 is preferably manufactured from steel which is plated to prevent corrosion. Piston 16 includes a generally circular section 32 and a piston body 34. Circular section 32 of piston 16 is positioned within circular section 28 of chamber 22 which simultaneously positions piston body 34 of piston 16 within sector-shaped section 26 of chamber 22. Piston 16 pivots within chamber 22 guided by circular section 32 of piston 16 and circular section 28 of chamber 22. A pair of rectangular U-shaped seals 36 seal the interface between piston 16 and body 12 and the interface between piston 16 and cover plate 14 after installation of cover plate 14 as detailed below. Seals 36 are preferably made from Carboxylated Nitrile which does not typically require lubrication.

Ram 18 is a generally rectangular shaped member preferably manufactured from steel. The rectangular shape of ram 18 prevents rotation of ram 18 and ram 18 is preferably plated to prevent corrosion or prevent the retention of contaminants such as weld spatter. Ram 18 is slidably disposed within rectangular section 24 of chamber 22 and is movable between a retracted position shown in FIG. 2 and an extended position shown in FIG. 3. A pair of rectangular U-shaped seals 40 seal the interface between ram 18 and body 12 and the interface between ram 18 and cover plate 14 after installation of cover plate 14 as detailed below. Seals 40 are preferably made from Carboxylated Nitrile which does not typically require lubrication.

Link 20 extends between piston 16 and ram 18 and is pivotally connected to each one. Link 20 is preferably manufactured from steel and is coated to prevent 10 corrosion. Link 20 includes a circular portion at one end which defines a circular aperture 44. Aperture 44 is designed to mate with an aperture 46 extending through ram 18. Link 20 is inserted into a slot 48 formed in the inner end of ram 18. Aperture 44 is aligned with aperture 46 and a link pin 50 is inserted through apertures 44 and 46 to pivotally attach link 20 with ram 18. Link pin 50 is preferably manufactured from bearing bronze. The opposite end of link 20 includes a circular portion which defines a circular aperture 54. Aperture 54 is designed to mate with an aperture 56 extending through piston 16. Link 20 is inserted into a slot 58 formed in piston body 34 of piston 16. Aperture 54 is aligned with aperture 56 and a link pin 60 is inserted through apertures 54 and 56 to pivotally attach link 20 with piston 16. Link pin 60 is preferably manufactured from bearing bronze.

Figure 2:
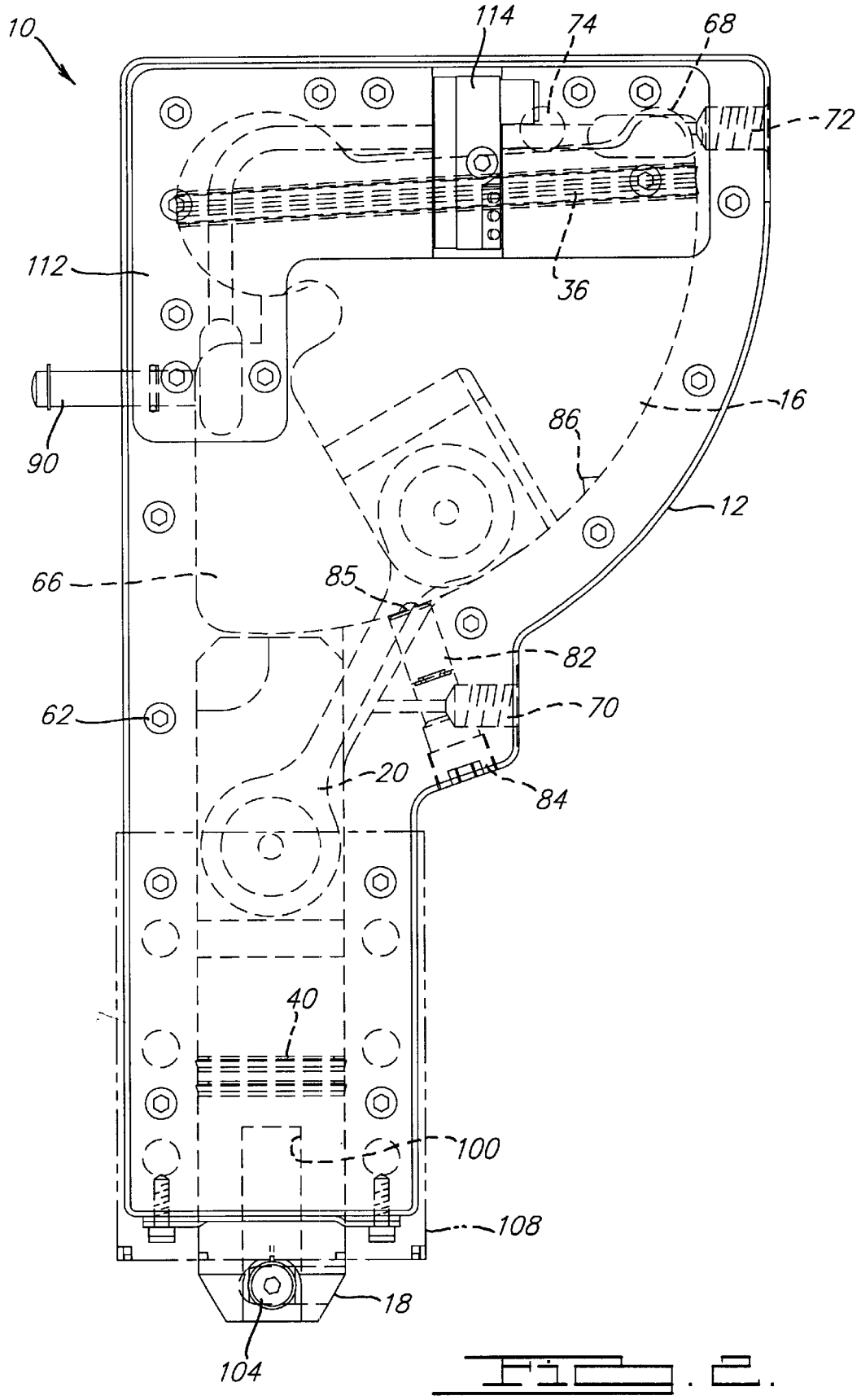
FIG. 2 is a top plan view of the shot pin shown in FIG. 1 with the ram in the retracted position.
Figure 3:
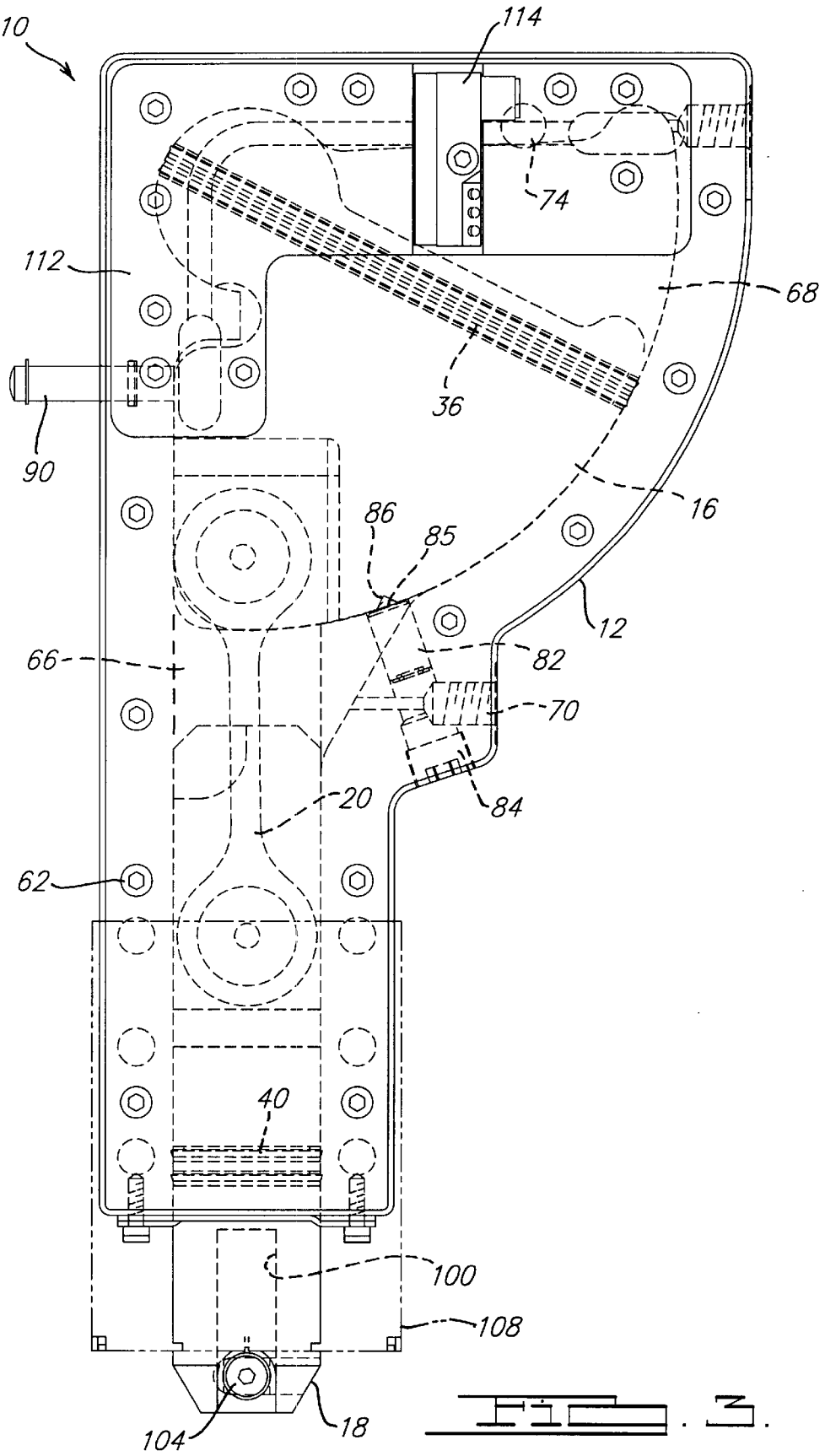
FIG. 3 is a top plan view of the shot pin shown in FIG. 1 with the ram in the extended position.
Figure 4:
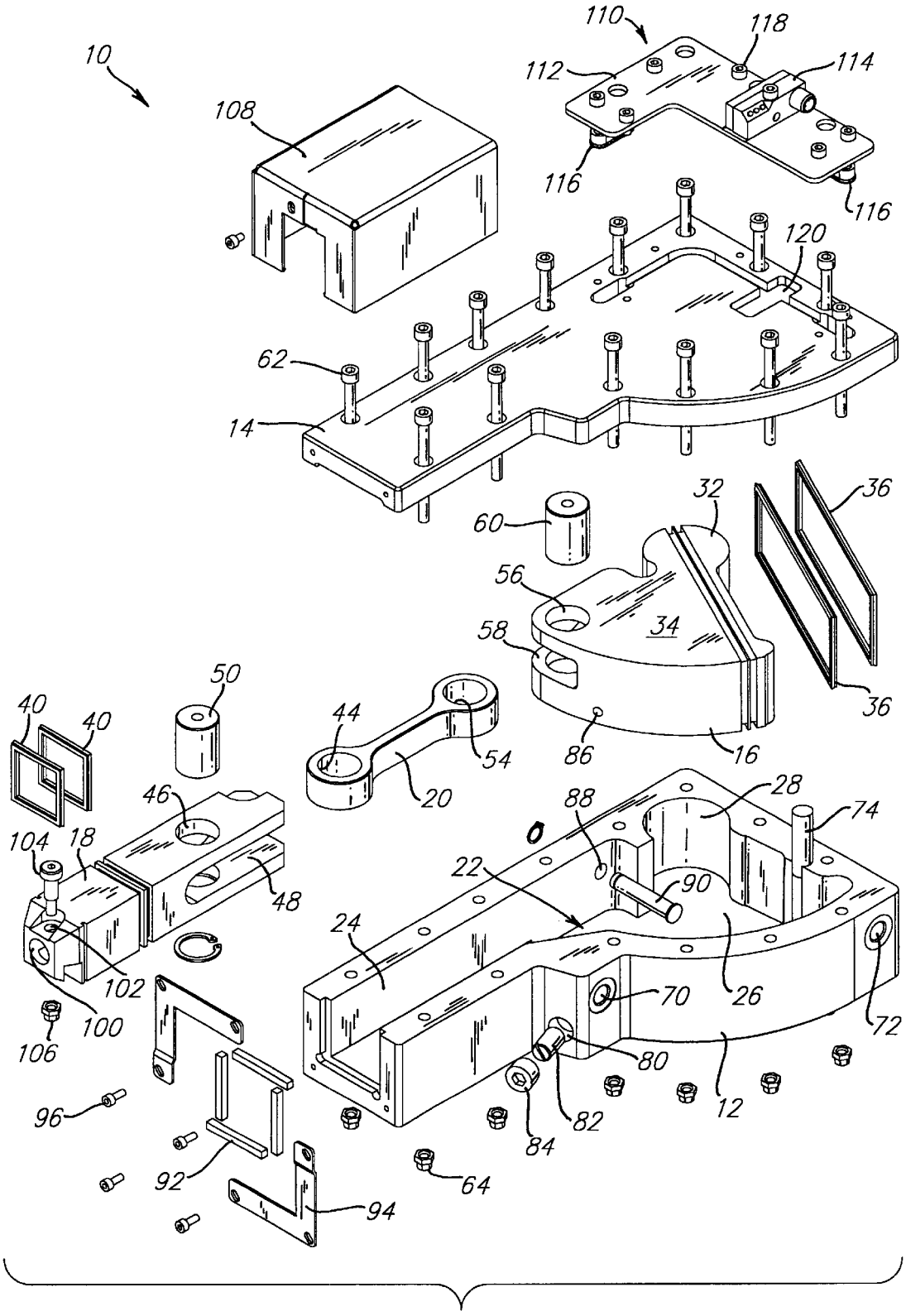
FIG. 4 is an exploded perspective view of the shot pin shown in FIG. 1.

The pivoting movement of piston 16 within chamber 22 thus causes reciprocating movement of ram 18 within chamber 22 through link 20. Ram 18 is normally positioned in its retracted position as shown in FIG. 2. When piston 16 is pivoted clockwise to the position shown in FIG. 3, link 20 moves ram 18 into its extended position. When the full clockwise movement of piston 16 has been reached and ram 18 is fully extended, link 20 is moved to an over-center linkage position to lock ram 18 in its fully extended position. Any axial load exerted on ram 18 towards its retracted position will attempt to move piston 16 further in a clockwise direction urging piston 16 against the wall of body 12. When in its extended position, pivoting of piston 16 in a counter-clockwise direction will move ram 18 to its retracted position shown in FIG. 2. Once piston 16, ram 18 and link 20 are attached to each other and positioned within chamber 22, cover 14 is sealingly attached to body 12 by a plurality of bolts 62 and a plurality of nuts 64. Preferably, a non-silicone adhesive/sealant is used between body 12 and cover 14. During assembly of ram 18, it is necessary for ram 18 to fit precisely within rectangular section 24 of chamber 22. Body 12 which forms chamber 22 is preferably made from aluminum and it is hard coated for wear purposes. A coating of Teflon® (Fluorocarbon) on body 12 makes up any tolerances and it produces an excellent ram 18 to body 12 fit with little tolerance and high lubricity. Cover 14 engages seals 36 and 40 to provide a sealed space 66 on one side of piston 16 and a sealed space 68 on the opposite side of piston 16.

Body 12 defines a fluid port 70 which is in communication with sealed space 66 and a fluid port 72 which is in communication with sealed space 68. When pressurized fluid is provided to sealed space 66 through fluid port 70, piston 16 is moved in a counter-clockwise direction to the position shown in FIG. 2. An elastomeric cushion 74 is positioned in a slot formed in body 12 to cushion the contact of piston 16 with body 12 in the counter-clockwise direction. The counter-clockwise movement of piston 16 retracts ram 18. When pressurized fluid is provided to sealed chamber 68 through fluid port 72, piston 16 is moved in a clockwise direction to the position shown in FIG. 3.

The clockwise movement of piston 16 extends ram 18 and positions link 20 into its over-center position. Thus, by alternately supplying pressurized fluid to ports 70 and 72, ram 18 can be alternately retracted and extended.

One feature of the present invention is its ability to lock ram 18 in its extended position (FIG. 3) in the event that fluid pressure to fluid port 72 is inadvertently lost. For safety reasons, once ram 18 is extended to punch, hold or otherwise engage an object, inadvertent loss of the fluid pressure to fluid port 72 could release the clamping load and possibly present a safety concern. Body 12 defines a retention bore 80 within which is positioned a ball plunger 82 and a sealed pipe plug 84. Ball plunger 82 includes a ball 85 which is spring biased such that it extends into chamber 22. Piston body 34 of piston 16 defines a dimpled detent 86 which engages ball 85 of ball plunger 82 when piston 16 is pivoted clockwise which is when ram 18 is extended and link 20 is in its over-center position. By supplying sufficient fluid pressure to chamber 66 through port 70, ball 85 of ball plunger 82 will be released from detent 86 allowing the counter-clockwise pivoting of piston 16 and the retraction of ram 18.

When fluid pressure has been inadvertently lost and piston 16 is being retained by ball plunger 82 and the over-center position of link 20, it may be desirable to have the capability of manually retracting ram 18. Body 12 defines a release aperture 88 through which an unlock pin 90 extends. A seal seals the interface between unlock pin 90 and body 12. When piston 16 is being retained by ball plunger 82 with ram 18 in its extended position, axial load applied to unlock pin 90 will pivot piston 16 counterclockwise to manually retract ram 18. Unlock pin 90 is assembled from inside chamber 22 and it includes a head or flange to prevent the possibility of "blow out".

The outer end of ram 18 is protected by a plurality of elastomeric wiper seals 92 which are secured to body 12 through a pair of hardened scrapers 94 using a plurality of bolts 96. Scrapers 94 and wipers 92 operate to clean ram 18 during its reciprocation motion. The pair of scrapers 94 constitute a single overlapping adjustable scraper. The design of each scraper 94 over the 90° angle of ram 18 produces a metal to metal optimum scraper while at the same time, scrapers 94 compress wipers 92 to further keep ram 18 clean. In addition, the design of wipers 92 and 94 allow for their replacement and adjustment from the outside of shot pin 10.

The outer end of ram 18 defines an axial bore 100 and a transverse bore 102 which intersects bore 100. Bore 100 is adapted to receive a head or a tool having a bore which aligns with bore 102. Once assembled, a bolt 104 and nut 106 are used to secure the head or tool within bore 100. A protective shield 108 is attached to ram 18 to further provide protection for ram 18.

During the retraction and extension of ram 18, the manufacturing system utilizing shot pin 10 may need to know whether ram 18 is in its extended position or if it is in its retracted position. Shot pin 10 includes a switch package 110 which is mounted to the exterior surface of cover 14. Switch package 110 comprises a switch cover 112, a status controller switch 114 and a pair of sleeves 116. Status controller switch 114 is attached to switch cover 112 and switch cover 112 is attached to body 12 using a plurality of bolts 118. A slot 120 formed into cover 14 accepts switch 114 and sleeves 116. A pair of switch targets, not shown, are machined onto piston 16 to allow for the monitoring of the position of piston 16 and thus ram 18 by switch package 110. Switch package 110 is in communication with the appropriate controller as is well known in the art.

The present invention provides a shot pin that has the ability to replace various models and sizes of prior art designs. The amount of stroke for ram 18 can be dictated by the design of piston 16 while still maintaining the advantages of piston 16 such as the over-center stop position, the detent ball locking feature and the manual unlock feature. The pivoting piston design of the present invention uses less air than an equivalent air cylinder of equal stroke and it is able to have withdrawal forces of 4500 pounds at 0.01 inches from the end of the stroke using 80 PSI air pressure. The amount of load exerted by the ram can be controlled by controlling either or both of the pressure of the pressurized fluid and the size of the piston area open to the pressurized fluid.

While the above detailed description describes the preferred embodiment of the present invention, it should be understood that the present invention is susceptible to modification, variation and alteration without deviating from the scope and fair meaning of the subjoined claims.

What is claimed is:

1. A fluid device comprising:

a body defining a chamber;

a piston disposed within said chamber, said piston being movable between a first position and a second position;

a ram disposed within and extending from said chamber, said ram being movable between a retracted position and an extended position;

a link pivotably secured between said ram and said piston, said link causing said ram to be in said retracted position when said piston is in said first position and causing said ram to be in said extended position when said piston is in said second position; and a mechanical member movable from a disengaged position when said piston is in said first position to an engaged position when said piston is in said second position for retaining said piston in said second position, said mechanical member being moved from said disengaged position to said engaged position by movement of said piston.

2. The fluid device according to claim 1, wherein said mechanical member includes a ball disposed within one of said body and said piston and a detent defined by the other of said body and said piston.

3. The fluid device according to claim 1, further comprising a manual release for manually moving said piston from said second position towards said first position.

4. The fluid device according to claim 1, wherein said ram defines a longitudinal axis and said mechanical member includes said link, said link being movable from one side of said longitudinal axis to an over-center position on the other side of said longitudinal axis.

5. The fluid device according to claim 4, wherein said mechanical member further includes a ball disposed within one of said body and said piston and a detent defined by the other of said body and said piston.

6. The fluid device according to claim 1, further comprising a wiper seal disposed between said body and said ram.

7. The fluid device according to claim 6, further comprising a scraper secured to said body and in engagement with said ram.

8. The fluid device according to claim 1, further comprising a scraper secured to said body and in engagement with said ram.

9. The fluid device according to claim 1, wherein said ram is rectangular in cross-section.

10. The fluid device according to claim 1, further comprising a switch package for determining whether said piston is in said first or said second position.

11. A fluid device comprising:

a body defining a chamber;

a piston disposed within said chamber, said piston being pivotable between a first position and a second position;

a ram disposed within and extending from said chamber, said ram being longitudinally movable along a ram axis between a retracted position and an extended position;

a link pivotally secure to said piston and said ram, said link defining a link axis, said link axis forming a first acute angle with respect to said ram axis when said piston is in said first position and said ram is in said retracted position, said link axis forming a second acute angle with respect to said ram axis when said piston is in said second position and said ram is in said extended position, said first acute angle and said second acute angle being on opposite sides of said ram axis.

12. The fluid device according to claim 11, further comprising a ball disposed within one of said body and said piston and a detent defined by the other of said body and said piston, said ball engaging said detent when said piston is in said second position.

13. The fluid device according to claim 12, further comprising a manual release for manually moving said piston from said second position towards said first position.

14. The fluid device according to claim 11, further comprising a manual release for manually moving said piston from said second position towards said first position.

15. The fluid device according to claim 11, further comprising a wiper seal disposed between said body and said ram.

16. The fluid device according to claim 15, further comprising a scraper secured to said body and in engagement with said ram.

17. The fluid device according to claim 11, further comprising a scraper secured to said body and in engagement with said ram.

18. The fluid device according to claim 11, wherein said ram is rectangular in cross-section.

19. The fluid device according to claim 11, further comprising a switch package for determining whether said piston is in said first or said second position.

20. A fluid device comprising:

a body defining a chamber;

a piston disposed within said chamber, said piston being movable between a first position and a second position;

a ram disposed within and extending from said chamber, said ram being movable between a retracted position and an extended position;

a link pivotably secured between said ram and said piston, said link causing said ram to be in said retracted position when said piston is in said first position and causing said ram to be in said extended position when said piston is in said second position; and a manual release slidingly received by said body, said manual release including a pin which engages said piston to urge said piston from said second position towards said first position.

* * * * *

UNITED STATES PATENT AND TRADEMARK OFFICE

CERTIFICATE OF CORRECTION

PATENT NO. : 6,450,082 B1
DATED : September 17, 2002
INVENTOR(S) : Edwin G. Sawdon It is certified that error appears in the above-identified patent and that said Letters Patent is hereby corrected as shown below:

Column 1,
Line 59, “improvement” should be -- improvements --.

Column 2,
Line 55, after “prevent” delete “10”.

Column 6,
Line 1, “secure” should be -- secured --.

Signed and Sealed this

Twenty-fourth Day of December, 2002

JAMES E. ROGAN
*Director of the United States Patent and Trademark Office*